US010472161B2

(12) United States Patent
Sater et al.

(10) Patent No.: US 10,472,161 B2
(45) Date of Patent: Nov. 12, 2019

(54) USING MAGNETISM TO SECURE THE DETACHABLE SPRAY-EXTENSION TUBE TO AN AEROSOL SPRAY CAN TO PREVENT MISPLACEMENT OR LOSS

(71) Applicant: MAGTUBE, LLC, Strongsville, OH (US)

(72) Inventors: Bernard L. Sater, Strongsville, OH (US); Neil D. Sater, Brecksville, OH (US)

(73) Assignee: MAGTUBE, LLC, Strongsville, OH (US)

( * ) Notice: Subject to any disclaimer, the term of this patent is extended or adjusted under 35 U.S.C. 154(b) by 13 days.

(21) Appl. No.: 15/328,788

(22) PCT Filed: Jul. 21, 2015

(86) PCT No.: PCT/US2015/000078
§ 371 (c)(1),
(2) Date: Jan. 24, 2017

(87) PCT Pub. No.: WO2016/014111
PCT Pub. Date: Jan. 28, 2016

(65) Prior Publication Data

US 2017/0203908 A1 Jul. 20, 2017

Related U.S. Application Data

(60) Provisional application No. 62/176,449, filed on Feb. 20, 2015, provisional application No. 62/122,952,
(Continued)

(51) Int. Cl.
*B65D 83/30* (2006.01)
*B65D 83/38* (2006.01)
(Continued)

(52) U.S. Cl.
CPC ..... *B65D 83/303* (2013.01); *B65D 83/38* (2013.01); *H01F 1/11* (2013.01); *B05B 15/62* (2018.02)

(58) Field of Classification Search
CPC ..... H01F 7/0215; B65D 83/38; B65D 83/28; B65D 83/30; B65D 83/303; B65D 83/753; B65D 83/7532; B05B 11/0089
(Continued)

(56) References Cited

U.S. PATENT DOCUMENTS 3,159,372 A * 12/1964 McIntosh ..... A47G 1/17 24/303
3,746,177 A * 7/1973 Vilotti ..... F41A 23/18 211/64
(Continued)

OTHER PUBLICATIONS

International Search Report and Written Opinion for PCT Application Serial No. PCT/US2015/000078, dated Oct. 29, 2015, 11 pages.
(Continued)

*Primary Examiner* — Patrick M. Buechner
(74) *Attorney, Agent, or Firm* — Amin, Turocy & Watson, LLP

(57) ABSTRACT

Methods and systems using magnetism to securely hold detachable spray-extension straws to aerosol cans to prevent their misplacement or loss are presented. Created from inexpensive magnetic plastic material: one is a magnetized straw that alone will securely attach to a spray can, and others are a variety of magnetized devices that will affix the straw on the surface of spray cans by magnetic attraction forces. Each device variation is designed to grasp and hold a conventional plastic straw while magnetically attached to an aerosol can.

8 Claims, 6 Drawing Sheets

Related U.S. Application Data filed on Nov. 3, 2014, provisional application No. 61/999,341, filed on Jul. 24, 2014.

(51) Int. Cl.
*H01F 1/11* (2006.01)
*B05B 15/62* (2018.01)

(58) Field of Classification Search
USPC ..... 222/402.1–402.25, 320–321.9, 23–51, 222/530, 538; 248/309.4
See application file for complete search history.

(56) References Cited

U.S. PATENT DOCUMENTS 5,178,354 A * 1/1993 Engvall ..... B65D 23/12 215/391
5,244,021 A * 9/1993 Hau ..... B67D 7/0238 141/285
5,275,304 A 1/1994 Abrams
5,388,730 A * 2/1995 Abbott ..... B65D 83/205 222/153.13
5,409,145 A * 4/1995 Payne ..... B65D 23/12 222/212
5,511,355 A * 4/1996 Dingler ..... E04C 3/07 52/309.16
5,621,368 A * 4/1997 Galloway ..... B65D 23/12 206/350
5,722,561 A 3/1998 Biondich et al.
6,269,985 B1 * 8/2001 Brody ..... B65D 83/303 222/538
6,315,152 B1 * 11/2001 Kalisz ..... B65D 83/303 215/390
6,659,313 B1 * 12/2003 MacMurdo ..... B05B 11/0005 222/530
D517,913 S * 3/2006 Mouyos ..... D9/434
D623,056 S * 9/2010 Sessa ..... D11/26
2003/0052140 A1 * 3/2003 Mouyos ..... B65D 83/303 222/538
2004/0094443 A1 5/2004 MacMurdo
2005/0000702 A1 * 1/2005 Shim ..... A62C 13/76 169/51
2008/0087785 A1 * 4/2008 Roche ..... A47B 81/005 248/309.4
2012/0227237 A1 * 9/2012 Tabuchi ..... B29C 51/12 29/428
2012/0240357 A1 9/2012 Nasiatka
2013/0130000 A1 * 5/2013 Deetz ..... B32B 9/043 428/215
2013/0264400 A1 * 10/2013 Crandley ..... B65D 83/303 239/589
2017/0065140 A1 * 3/2017 Bradbury ..... A47L 13/16
2018/0193856 A1 * 7/2018 Batinkoff ..... B05B 11/001

OTHER PUBLICATIONS

Canadian Office Action for Canadian Application Serial No. 2,956,062 dated Jan. 19, 2018, 5 pages.
Extended European Search Report for European Application Serial No. 15824899.7 dated Feb. 9, 2018, 6 pages.

* cited by examiner

USING MAGNETISM TO SECURE THE DETACHABLE SPRAY-EXTENSION TUBE TO AN AEROSOL SPRAY CAN TO PREVENT MISPLACEMENT OR LOSS

CROSS REFERENCE TO RELATED APPLICATIONS

This application is a 371 national stage of PCT Application Serial No. PCT/US15/00078, filed Jul. 21, 2015 and entitled, "USING MAGNETISM TO SECURE THE DETACHABLE SPRAY-EXTENSION TUBE TO AN AEROSOL SPRAY CAN TO PREVENT MISPLACEMENT OR LOSS," which claims priority to and the benefits of U.S. Provisional Patent Application 61/999,341 dated Jul. 24, 2014; U.S. Provisional Patent Application 62/122,952 dated Nov. 2, 2014; and U.S. Provisional Patent Application 62/1/76,449 dated Feb. 20, 2015, entitled USING MAGNETISM TO SECURE THE DETACHABLE SPRAY-EXTENSION TUBE TO AN AEROSOL SPRAY CAN. The above-identified patent applications are incorporated herein by reference in their entireties for all purposes.

FIELD OF THE INVENTION

The present invention relates to methods and systems using magnetic attraction force to hold a detachable spray-extension tube along the side of an aerosol spray to prevent its misplacement or loss, when not being used.

BACKGROUND OF RELATED ART

Aerosol spray cans are widely used to dispense lubricants, paints and solvents. Spray can nozzles are designed to dispense a diffused spray. However some applications require a fine localized spray stream, in which case a plastic spray-extension tube can be inserted into a recessed hole provided in the spray nozzle to guide the spray stream as directed, as shown in FIG. 1. Spray-extension "tubes" are often referred to as "straws", and the terms are used interchangeably herein. Generally the plastic spray-extension tube is easy to insert and remove to accommodate user needs, but unfortunately it is also easily misplaced or lost when not securely attached to the spray can.

An aerosol spray lubricant, such as WD 40, is an example of the current state of art with a detachable plastic spray-extension tube that can be inserted into the nozzle for fine directed spray control. The detachable plastic spray-extension tube is usually attached to the side of the spray can with a piece of clear tape, to prevent its loss in shipping and handling before being purchased. However the attachment tape is not permanent, and often fails in use after purchase. As a result, detachable spray-extension tubes are frequently misplaced or lost by consumers.

Because misplacing or losing spray-extension tubes has been a common problem with aerosol spray cans, there are businesses selling replacement spray-extension tubes, and there have been a variety of concepts proposed and developed to prevent this problem.

For example, US Patent 20120240357 abstract discloses "An elastic band specially configured where the two ends are joined together to form an aperture for inserting and securing a plastic extension tube to an aerosol spray can."

Furthermore, WD-40 Company developed a method for preventing misplacement or loss of spray-extension tubes when not being used. WD-40 Company markets their "Smart Straw™" product disclosed in U.S. Pat. No. D 536,970, which has a hinged plastic tube that can be rotated upward for fine guided spray control, or rotated downward to be out of the way for normal nozzle spraying and for safe stowing.

Although the Smart Straw™ design is elegant, it is an expensive solution. The premium cost of this solution adds to the consumer price for the product, and likely inhibits sales. Furthermore, this solution is a fully integrated product; so if the "Smart Straw™" device fails, the entire aerosol spray product may be rendered useless. What is needed is a very low cost and replaceable solution for affixing the straw to the can during shipping and storage and when the straw is not otherwise required for use.

Non-obvious new methods and systems are taught herein that are based on using magnetic attraction forces to affix the detachable spray-extension tube to the side of an aerosol spray can, as the means to prevent its misplacement or loss when not being used.

SUMMARY OF THE INVENTION

Novel new concepts are disclosed herein that use magnetism to create sufficient magnetic attraction force to affix the detachable spray-extension tube along the side of an aerosol spray can when not being used, as a method to prevent its misplacement or loss:

One concept is an inexpensive magnetized plastic spray-extension tube as illustrated in FIG. 2, which in itself has sufficient magnetic attraction force to affix the straw on the side of an aerosol can, as shown in FIG. 3. It should be understood that a portion of the magnetic attraction force comes from magnetic fringe fields and not actual physical contacting. It is the magnetic flux density at any given point that is the measure of magnetic field strength. Also it should be understood that manufacturers skilled in the art will be able to inexpensively produce magnetized plastic spray-extension tubes suitable for the present innovations.

Since a conventional round small diameter conventional plastic spray-extension tube will have little actual physical surface contact area with a much larger round diameter aerosol spray can, several magnetized spray-extension tube cross-sectional configurations, or shapes, are disclosed herein as shown in FIGS. 4 and 5 that will increase physical surface contact area to improve the magnetic attraction holding force to the side of an aerosol can. Also the flattened shapes can be confined to just a portion of the tube while keeping the ends round for conventional nozzle insertion.

Another concept is a separate removable magnetized sleeve as shown in FIG. 6, that is able to be slipped on a conventional (non-magnetized) plastic spray-extension tube to to affix the combination to the side of an aerosol spray can with magnetic attraction force, when the tube is not being used.

Another concept shown in FIG. 7 is a durable clip formed of permanent magnet material to affix a tube to the side of an aerosol can for safekeeping; however it can be easily lifted for tube removal, or when the clip is needed for use on another aerosol spray can. In this way the durable clip may be considered interchangeable because it can be used on more than one aerosol spray can.

Although not shown, another concept is simply a strap of flexible magnetized ribbon that will affix a conventional spray extension tube against an aerosol can's side for safekeeping; yet it can be easily peeled away from the can to remove the tube, as needed. In this respect, key design features of both the durable magnetized clip and the flexible strap of magnetized ribbon concepts are that they are able to repeat their attachment, detachment, and reattachment functions multiple times without degradation of their magnetic attraction holding forces.

In another version of a reusable clip, a fastener feature is incorporated near the middle with a fastener designed as a channel to securely grasp and hold a spray-extension tube, as shown in FIG. 8. In addition the clip has a magnetized surface contact area that substantially matches the contour of the outer perimeter of an aerosol can. An additional feature of this clip design as well as other variations discussed herein is that it is low in weight, which means it can remain attached to the tube during use and yet be readily re-stowed along the side of the aerosol can after use, for safekeeping. Furthermore being reusable means that after the contents of an aerosol can is emptied, the magnetized clip can be transferred to a new can, where it is able to continue performing its functions with the spray-extension tube on the new can.

In contrast to prior art concepts having elastic bands that stretch completely around the aerosol can, the magnetized fasteners only need to span a small portion of the outer periphery surface of an aerosol can to securely hold a conventional spray-extension tube when it is not being used. Moreover, a very important fact is that magnetic attraction holding forces created by magnetism are not affected by lubricant or solvent residuals, or other contaminants such as dirt or grease that may be present on the aerosol can surface. Because of this advantage, magnetic attraction forces are totally unlike adhesive forces.

Although not shown, another version of a clip fastener design such as shown in FIG. 8 would be able to grasp and hold more than one different diameter tube. For example, the different channels can be nested inside one another, where the opening for a tube of a smaller diameter is located inside the opening for a larger diameter tube.

As another example, the openings for different size tubes could be distinct, incorporated next to one another. Designing the clip to accommodate different diameter tubes would be a useful feature, considering aerosol product producers often use different diameter tubes for different products, and having one clip design suitable for several different products is advantageous.

Finally, several concepts are disclosed for creating a magnetic receptive surface on spray containers that are made from non-magnetic material such as aluminum or plastic, instead of the traditional steel. These concepts create a magnetic receptive attachment surface that is suitable for enabling sufficient magnetic attraction force to affix a spray-extension tube to the container while using any of the magnetized concepts disclosed herein.

DETAILED DESCRIPTION OF THE INVENTION

Magnetism is used to create magnetic attraction forces that will affix a detachable spray-extension tube (also referred to as a straw) to an aerosol spray can as the method to prevent its misplacement or loss, when not being used. Several inexpensive new and novel concepts using magnetism are disclosed. For example, a magnetized detachable plastic spray-extension tube configuration shown in FIGS. 2, 3, 4 and 5, can be inserted in the nozzle of an aerosol can for use in directing a fine spray; but when removed, its magnetic attraction forces alone will affix the tube to the aerosol can for safekeeping. Other disclosed examples are magnetized sleeves, clips, and straps that are able to affix a conventional (not magnetized) spray-extension tube on an aerosol can, when not being used. All concepts disclosed herein use magnetism as an inexpensive and reliable method to affix the detachable spray-extension tube to an aerosol can to prevent misplacement or loss when the tube is not being used.

Manufacturers skilled in the art will be able to inexpensively produce the disclosed magnetized plastic spray-extension tubes and/or magnetized devices that are suitable implementations. In most cases, the manufacturing technology involved will be similarly related to that used in making inexpensive plastic refrigerator magnets, or flexible magnetized plastic sheets used for creating removable signs that magnetically attach to vehicles or other metal surfaces, which are formed from a thermoplastic rubber or a plastic material that is compounded with ferromagnetic material such as fine iron particles, magnetite ($Fe_3O_4$), hematite ($Fe_2O_3$), or ferric oxide ($Fe_2O_4$), which are relatively weak but low cost magnetic materials. Stronger magnetic materials such as iron (Fe), alnico (containing Al, Ni and Co), neodymium (Nd), or some alloys of rare earth metals are also available for use, but they are generally more expensive. After compounding, two-dimensional cross-sectional plastic magnetic products such as tubes, or tube-holding devices disclosed herein can be produced using an extrusion process, as an example. In a final step the extruded product is magnetized, or polarized, by strong external magnetic fields to induce a pattern of magnetic alignment of the embedded magnetic material.

Figure 9:
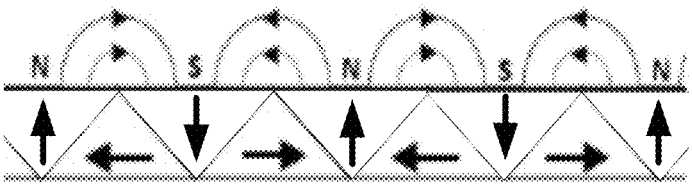
FIG. 9 is an example of a magnetized plastic sheet which shows closely spaced alternating lines of north (N) magnetic poles (up arrows) and south (S) magnetic poles (down arrows) with magnetic field lines emanating from the north poles to the south poles.

An example of a magnetized plastic sheet is shown in FIG. 9. It shows closely spaced alternating lines of north (N) magnetic poles (up arrows) and south (S) magnetic poles (down arrows) with magnetic field flux lines emanating from the north poles to the south poles. This magnetic polarization arrangement is produced in an extruded sheet passing over a line of powerful permanent magnets arranged in a stack with alternating magnetic poles. The processing step impresses or creates magnetic poles in an alternating line format (N, S, N, S, N, S, . . . ) in the plastic sheet with embedded magnetic material, like that disclosed in U.S. Pat. No. 7,728,706. The pole to pole spacing can be controlled by the spacing in the stack of permanent magnets. The basic design, called the Halback array, gives twice the magnetism on one side, which makes it more effective in attraction to a steel surface than a uniformly-polarized magnet, which will also work with the implementations disclosed herein. However manufacturers skilled in this art will be able to apply the most appropriate technologies needed to produce the innovations disclosed herein.

Figure 8:
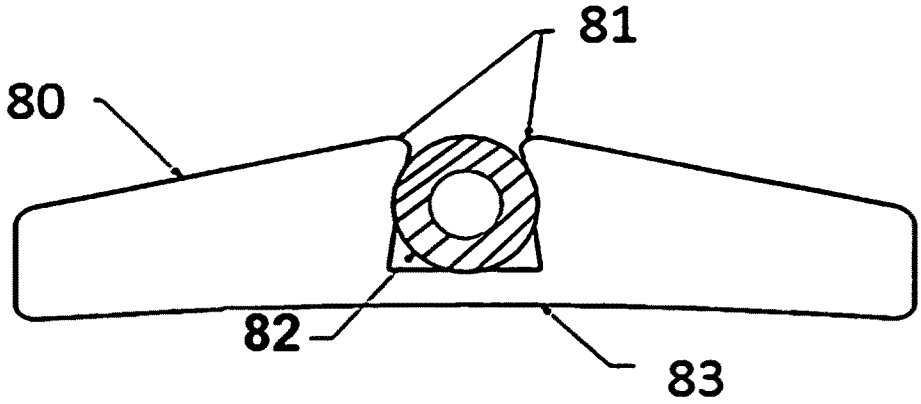
FIG. 8 is a cross-sectional profile of an extrusion (80) used by the Inventors in the initial product design of a magnetized clip, as an example embodiment. The design has nubs (81) that clutch a conventional small diameter spray-extension tube (82) that has been pressed down into the channel and provides a mating surface shape (83) that approximately corresponds to the aerosol can diameter, in order to provide optimal magnetic attraction and holding force.

The Inventors developed an extruded clip design (80) similar to that shown in FIG. 8 as the initial product. The design has nubs (81) that clutch a conventional small diameter spray-extension tube (82) that has been pressed down into the opening and provides a mating surface shape (83) that substantially matches the aerosol can surface shape, to maximize magnetic attraction and holding force. The initial product produced by this extrusion die profile using a metal-filled plastic material that was magnetized after formation proved effective and inexpensive, however other methods of forming, such as molding, casting, etc. could be employed. The trademark MagStraw™ was filed for this product.

Figure 10:
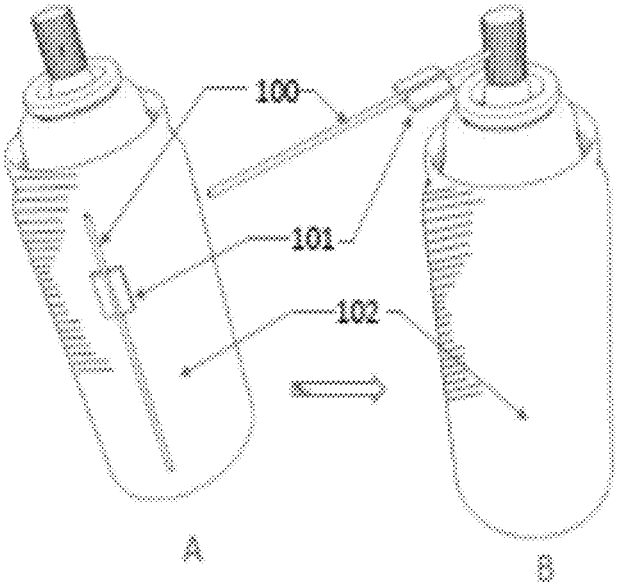
FIG. 10 A illustrates a spray-extension tube (100) held by a magnetized clip (101) that is magnetically affixed to an aerosol can (102) for safekeeping, as one embodiment. However FIG. 10 B illustrates the spray-extension tube (100) being used with the magnetized clip (101) remaining on the tube. The illustration shows normal spray-extension tube operation is possible because of the low clip weight and firm tube holding design.
Figure 11:
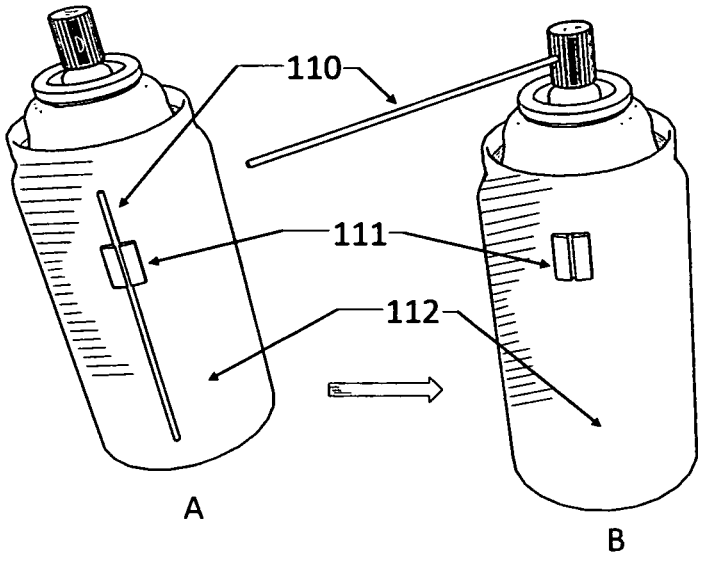
FIG. 11 A illustrates a spray-extension tube (110) held by a magnetized clip (111) that is magnetically affixed to an aerosol can (112) for safekeeping. However FIG. 11 B illustrates the spray-extension tube (110) being used for directed fine spray operation after being removed from the magnetized clip (111) that remains affixed to the can (112).

The initially produced MagStraw™ clips, which were 0.5 inches wide and 0.75 inches long, had more than sufficient magnetic holding force for securely affixing the straw to the side of the can. Furthermore because of the MagStraw™ clip's low weight, it could remain attached to the spray-extension tube while being used as illustrated in FIG. 10, and not interfere with normal tube spray operation. However, it is also possible to remove the spray-extension tube from the clip, keeping the clip affixed to the can's side, and using the tube alone, without the clip attached, as illustrated in FIG. 11.

The clip's profile was designed such that the nominal gap of the channel holding the straw is slightly smaller than the straw itself, so when the straw is inserted, it is held more firmly in place due to the opposing forces of the walls of the channel in the flexible clip.

Furthermore, the nominal concave contour of the magnetized mating surface (83) is slightly flatter than the convex curvature of the can it would mate to, such that when the straw is inserted, it will force the mating surface shape into a slightly sharper concave radius, more closely matching the can's curvature, and therefore increasing the magnetic attraction forces holding them together. The MagStraw™ clips proved be an inexpensive solution to the fundamental problem and well suited for the safekeeping application.

The calculated magnetic holding force in g's (gravitational force) of the initially produced MagStraw™ clip follows: The magnetized extruded material had a holding force of approximately 60 pounds per square foot (or 0.4156 pounds per square inch). The contacting surface area of the initially produced MagStraw™ clip is 0.375 square inches, giving a holding force of 0.1558 pounds. Since the total weight of the MagStraw™ clip with an inserted conventional plastic straw weighed 0.0043 pounds, the calculated magnetic holding force is equivalent to a 36.24 g-force. A holding force of one-g will hold the clip and straw from falling off the can's surface when held upside down, while higher levels will provide increased adherence to the can, if accidently dropped, so the holding force of 36.24 g-force is more than adequate for typical applications. It is to be appreciated that calculations included herein are merely examples, and are not intended to limit the invention.

Because the overall magnetic holding force of a clip is largely determined by the design of the magnetized surface area, cost savings are possible by accepting a lower designed holding force and clip area, so that less material, and/or a lower ratio of iron composition in the material may be used to reduce cost.

It should be clear that other magnetized designs are possible in accordance with the innovations disclosed herein for accommodating different sized tubes and aerosol cans and different configurations. For example, a magnetized clip, somewhat similar to that shown in FIG. 8, could be designed so that the channel where the straw would be inserted is located on the inner surface that faces the can, which is opposite to that shown in FIG. 8.

Figure 1:
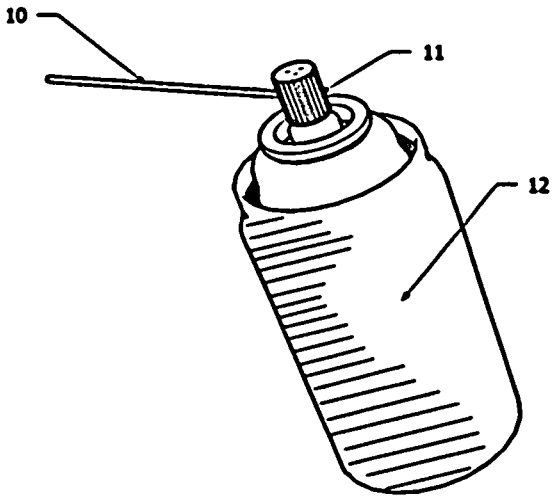
FIG. 1 is an illustration of a conventional round detachable spray-extension tube (10) inserted in the nozzle (11) of an aerosol can (12) for directing fine spray control.
Figure 2:
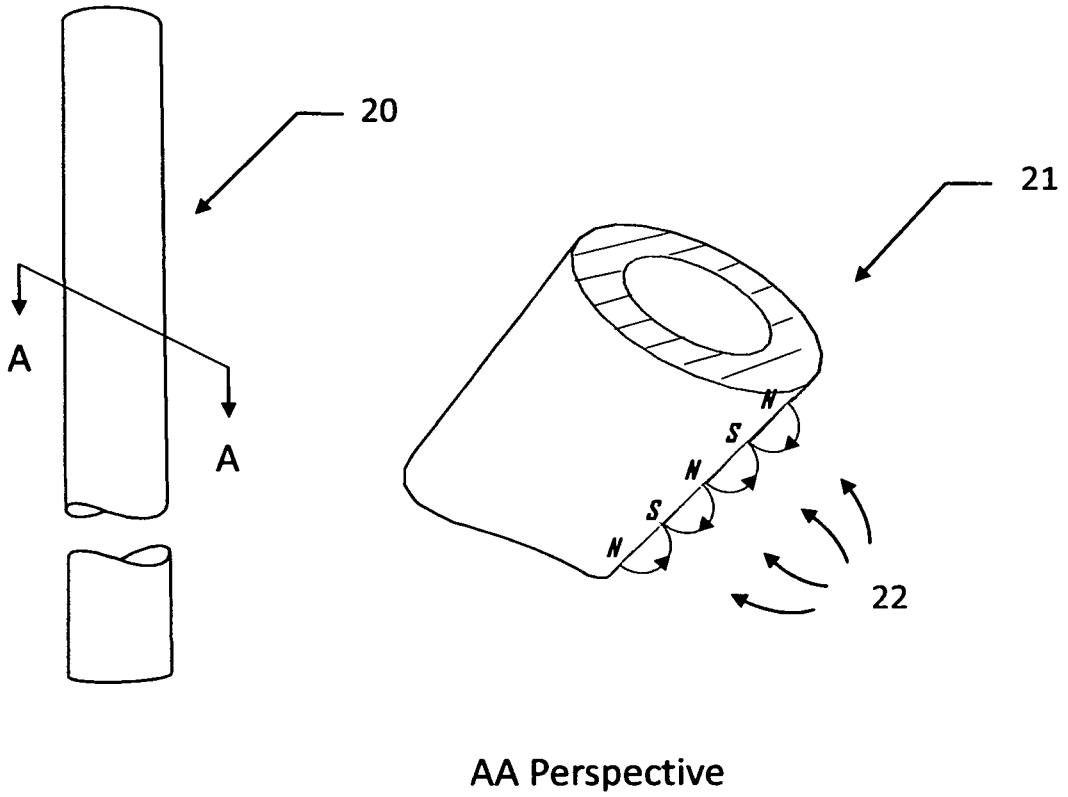
FIG. 2 is a representative drawing of a round small diameter magnetized plastic spray-extension tube (20) that has been magnetized. An expanded cutaway prospective AA view (21) shows alternating N, S, N, S, N, - - - magnetic poles (22) with their magnetic flux lines aligned along the tube, for providing sufficient magnetic attraction force to affix the tube on the side of an aerosol can for safekeeping when not being used.
Figure 3:
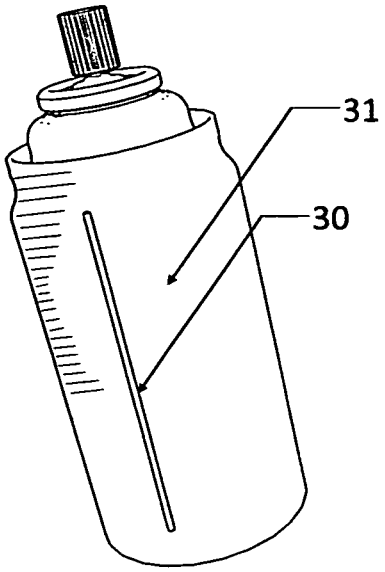
FIG. 3 shows a magnetized spray-extension tube (30) affixed to the side of an aerosol can (31) by magnetic attraction force for safe keeping.
Figure 4:
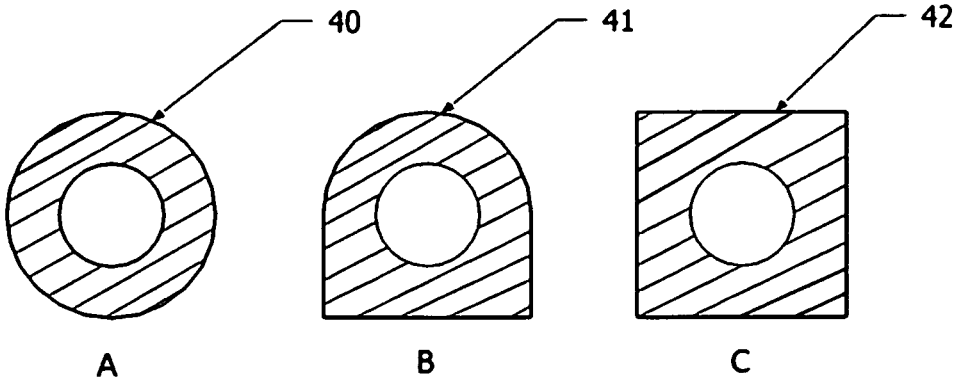
FIG. 4 shows several cross-sectional shapes, or configurations of spray-extension tubes that provide increased surface contact area to improve magnetic attraction force. Compared to the small round diameter spray-extension tube (40) of Configuration A, an improved configuration with one flattened side (41) is shown in Configuration B. Furthermore, other improved configurations are possible that have more than one flattened surface (42), such as that shown in Configuration C, which is square with four flattened sides.
Figure 5:
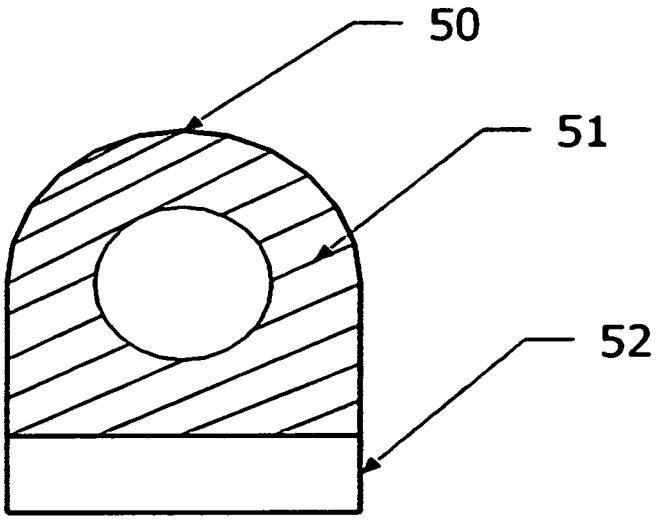
FIG. 5 shows a co-extrusion variation of FIG. 4, Configuration B. The tube design (50) combines a plastic material that is ideally suited for the spray tube (51), along with a co-extrusion layer (52) of magnetic plastic material considered more suitable for magnetization.
Figure 6:
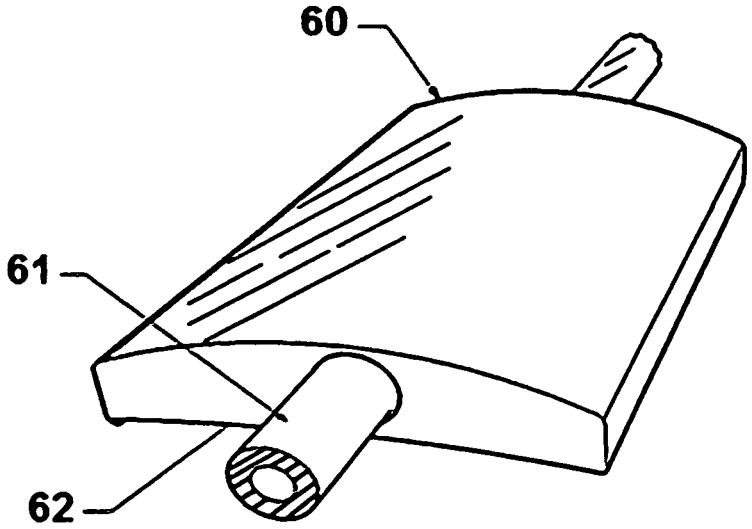
FIG. 6 is a sketch showing a separate and removable magnetized sleeve (60) that has been slipped over a conventional small diameter spray-extension tube (61). The magnetized surface (62) of the sleeve can be shaped to substantially match the contour of the aerosol can in order to maximize the magnetic holding force on the aerosol can side, when not used.

One embodiment is to magnetize the tube itself. Although a magnetized round small diameter plastic spray-extension tube as shown in FIG. 2 would have little actual surface contact area with an aerosol can, the magnetic fringe fields extending from the side of the tube also contribute to the holding force, which is the function of flux density. Nevertheless, improved magnetized spray-extension tube configurations or shapes are disclosed, which have one or more flattened sides, as shown in FIGS. 4 and 5. These improved configurations or shapes provide increased surface contact area between the tube and the aerosol can that will improve the magnetic attraction forces to more securely hold a spray-extension tube on the aerosol can for safekeeping.

According to the following definition: "tube—a long, hollow object that is used especially to control the flow of a liquid or gas", a tube does not have to be round. Increasing the actual surface contact area and/or narrowing the gap between the surfaces of a magnetized spray-extension tube and an aerosol spray can will improve the magnetic attraction holding force. Several cross-sectional shapes, or configurations of spray-extension tubes shown in FIG. 4 will provide increased surface contact area to improve magnetic attraction force, and/or will narrow the gap between the surfaces. Compared to a small round diameter conventional spray-extension tube (40) of Configuration A, an improved configuration with one flattened side (not round) is shown in Configuration B (41). Furthermore, other improved configurations are possible that have more than one flattened surface, such as that shown in Configuration C (42) with four flattened sides, or square shaped. It should be understood that the term 'flattened' is used herein in a relative sense, describing surfaces that may not be completely flat; for example, the surface described may have a slight concave shape, to substantially match the convex outer surface of a spray can.

For optimal operation, the shape of the receptacle in a spray can nozzle matches the shape of the insertion end of the spray-extension tube configuration, or shape chosen to provide firm assured insertion. However a spray nozzle receptacle can be designed so that it will accommodate both a round conventional small diameter Configuration A spray-extension tube and, as well, one of the flattened magnetized Configurations B or C. In doing so, a dual accommodating spray nozzle design could become a unique marketing feature for the manufacturer.

We can calculate the magnetic holding force in g's (gravitational force) of a magnetized Configuration C tube as follows: A conventional small round 0.084 inch OD plastic spray-extension tube that is 4.5 inches long that is made with polypropylene having a specific gravity of 0.946 gram/cm$^3$, weighs 0.0007 pounds. An equivalent size square magnetized Configuration C tube has a 36% larger volume and a higher specific gravity of 3.5 gram/cm$^3$ because of its magnetic material composition. As a result a magnetized Configuration C tube would weigh 0.00422 pounds. The surface contact area of Configuration C tube may be 0.3825 square inches, giving us a magnetic holding force of 0.1819 pounds, or the equivalent of 43.1 g-force.

The magnetic material suitable for clips, sleeves, or straps may not be optimal for magnetized straws. Although iron is an inexpensive magnetic material widely used with polyethylene in producing refrigerator magnets, it is reasonable to assume the magnetic holding force per unit area is proportional to the amount of iron in the plastic. Tradeoffs are possible by reducing the iron content to produce a less dense material and accepting a lower holding force.

As an example, if the iron content is reduced to 20%, the magnetic holding force of the Configuration C calculated in [0046] would be lower at 0.0438 pounds. But at the same time, the specific gravity of the material would be reduced to 2.33 grams/cm$^3$, which results in a lower Configuration C tube weight of 0.0028 pounds. As a result, the 20% example composition results in a magnetized spray tube with a lower holding force that is equivalent 15.59 g-force. The optimum material composition for magnetized spray tubes could be varied based on the application and cost factors.

Co-extrusion allows different materials to be extruded together to maximize overall properties. As shown in FIG. 5, the tube (50) combines a plastic material that is ideally suited for the spray tube (51), along with a co-extrusion layer (52) of magnetic plastic material considered more suitable for magnetization. Combining different materials in this manner optimizes the final product performance.

Figure 7:
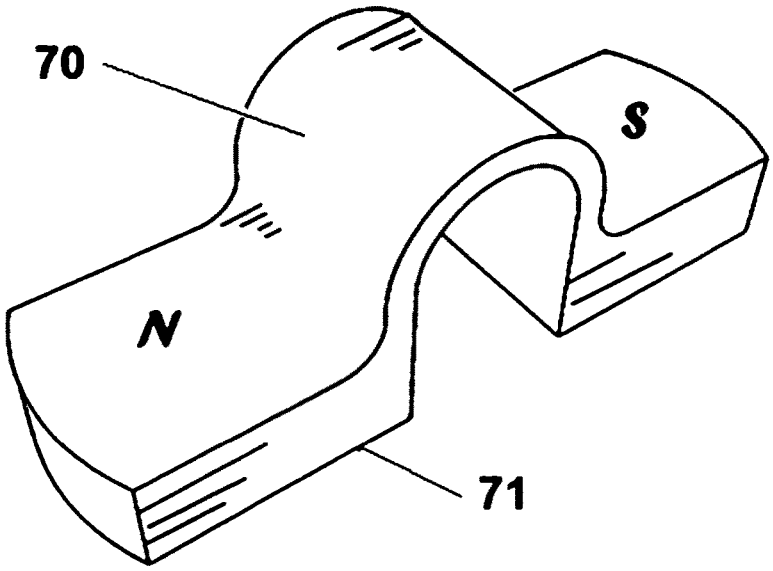
FIG. 7 is a conceptual sketch of a durable permanent magnetic clip (70) for holding a spray-extension tube along the aerosol spray, which is removable as an interchangeable part that can be used on more than one aerosol spray can. The attachment surface's shape (71) substantially matches the outer curvature of the perimeter of an aerosol spray can to maximize magnetic attraction force.

The durable interchangeable permanent magnetic clip shown conceptually in FIG. 7 can be made of permanent magnetic materials like metals, ceramics, or alloys formed by powder metallurgical processes. These include metals, such as iron (Fe), or alnico (containing Al, Ni and Co); and ceramic ferrites of iron oxides with other elements, such as Strontium ferrite, $SrFe_{12}O_{19}$, Barium ferrite, $BaFe_{12}O_{19}$ and Cobalt ferrite, $CoFe_2O_4$. Although not shown in the Figure, other embodiments could have a feature such as an indentation or groove formed in or on the surface of the clip to affix a tube to the clip for safekeeping.

For some applications a more robust design using different materials may be desirable, since some inexpensive materials may become prone to softening and becoming 'sticky' over time and/or in high temperature conditions, and/or because the materials may be slightly porous and prone to absorbing solvents or other contaminants, and/or because this form of magnetization can be lost in the presence of other magnetic fields. However from the description provided herein, those skilled in the art could perceive further improvements, changes and modifications. Such improvements, changes and modifications within the skill of the art are intended to be covered by the appended claims.

Furthermore it may be advantageous to incorporate an additional material in the compound prepared for production that would not affect performance or appearance of the final product, but could be detected by other means. For examples: (1) a dye added to the plastic that would not show visibly in the finished product, but could be detected by its fluoresce, or glow signature under black light that gives off energetic ultraviolet light; or (2) a small amount of another material that would not appear visually, but could be detected by analytical means. The purpose of adding these materials may be to locate the parts in a dark environment, for example, or otherwise make it possible to track and validate what materials have been used in making the final products.

Up to this point, the innovations described herein have been described in the context of functioning with an aerosol spray can made from steel, which is a magnetic receptive material ideally suited for the application. However for spray cans, or other types of containers that are not made with magnetic receptive material, there are other embodiments possible: the concept of incorporating a non-magnetized ferrous magnetic receptive surface on the outer periphery of a nonmagnetic container that would be suitable to securely hold any of the magnetized concepts disclosed herein (e.g., a magnetized plastic spray-extension tube or a magnetized sleeve or strap or clip), to affix the tube and prevent its misplacement or loss, when it is not being used.

The added ferrous magnetic receptive surface for magnetic attachment could be confined to a small segment on the outer surface of the container for this purpose. As examples, vertically oriented segments for holding magnetized spray-extension tubes, or horizontally oriented segments for magnetized clips, sleeves, or straps, etc. The magnetic receptive surface segment could be created by simply attaching a strip of a ferrous metal tape with a pressure-sensitive adhesion, or by applying a magnetic receptive paint that contains fine ferrous particles. Many paint companies, including Rust-Oleum (http://www.rustoleum.com/product-catalog/consumer-brands/specialty/magnetic/) formulate and market magnetic receptive paints that would be suitable for this embodiment. The receptive surface can be artistically incorporated into the label on the container.

Alternatively, for spray cans that are not steel, a receptive surface that is magnetized may be applied with adhesive, and a tube that contains non-magnetized ferrous material can be held on that surface of the can, or alternatively a conventional plastic tube can be held to that surface with any of the forms of clips, sleeves, or straps discussed herein that is made with ferrous materials.

Although the innovations disclosed have been mainly described in terms of a spray-extension tube for a lubricant like WD-40, it should be understood that they are equally useful for affixing tubes to other surfaces, such as the side of a toolbox, with minor modifications. Furthermore, it should be understood the innovations disclosed are equally useful for holding other detachable devices by magnetic attraction force, other than straws and spray cans. There may be advantages for product marketing and/or distribution in having an extrusion die or mold design that would allow more than one clip (or sleeve, for example) to be extruded or molded simultaneously side by side, but only slightly attached to one another so that they could be easily separated later. One advantage of this would be to reduce the tendency for the devices to magnetically mate with one another when shipped or packaged near one another. It should be understood that only certain embodiments have been described and that numerous substitutions, alternatives, dimensional changes, and modifications are permissible without departing from the scope of the innovations.

What is claimed is:

1. An aerosol spray can, comprising:

a cylindrical body, at least a portion of which is magnetic receptive;

a spray nozzle for dispensing an aerosol;

a straw adapted to attach to the spray nozzle for directing the aerosol;

wherein the straw is held in a flexible detachable straw holder comprised of an integrated composition of plastic or rubber, and magnetic materials adapted to magnetically attach to at least a magnetic receptive portion of the cylindrical body; and wherein the straw is held in the flexible detachable straw holder in any orientation, including inverted, when magnetically attached to the cylindrical body.

2. The aerosol spray can of claim 1, wherein the flexible detachable straw holder comprises a channel adapted to receive, hold and release a longitudinal portion of the straw.

3. A system, comprising:

a cylindrical object, at least a portion of which is magnetic receptive;

a spray nozzle for dispensing an aerosol from the cylindrical object;

a straw that attaches to the spray nozzle for directing the aerosol; and a flexible magnetic base that magnetically attaches to a portion of the cylindrical object that is magnetic receptive, wherein the flexible magnetic base holds a longitudinal portion of the straw when the straw is not attached to the spray nozzle, and wherein the flexible magnetic base is comprised of an integrated composition of flexible plastic or flexible rubber, and magnetic materials.

4. The system of claim 3, wherein the flexible magnetic base is adapted to remain affixed to the cylindrical object or the straw when attached to the spray nozzle for directing aerosol.

5. The system of claim 3, wherein the flexible magnetic base comprises an additional fluorescence material that is detectable by fluorescence when illuminated by ultraviolet light.

6. The system of claim 3, wherein the flexible magnetic base comprises a pattern of magnetic alignment of magnetic material.

7. The system of claim 3, wherein the flexible magnetic base comprises a magnetic field associated with a Halback array.

8. The system of claim 3, wherein the flexible magnetic base is further adapted to magnetically attach to a flat surface or an approximately flat surface of an object.

* * * * *